US007944462B2

(12) United States Patent
Sakurai

(10) Patent No.: US 7,944,462 B2
(45) Date of Patent: May 17, 2011

(54) EXPOSURE HEAD, IMAGE FORMING UNIT, AND IMAGE FORMING APPARATUS

(75) Inventor: Kazunori Sakurai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 38 days.

(21) Appl. No.: 12/359,728

(22) Filed: Jan. 26, 2009

(65) Prior Publication Data

US 2009/0201357 A1 Aug. 13, 2009

(30) Foreign Application Priority Data

Feb. 8, 2008 (JP) ..... 2008-028492

(51) Int. Cl.
*B41J 2/45* (2006.01)

(52) U.S. Cl. ..... 347/238

(58) Field of Classification Search ..... 347/241, 347/242, 256, 257, 230, 236–238, 246, 247
See application file for complete search history.

(56) References Cited

U.S. PATENT DOCUMENTS 6,989,849 B2 * 1/2006 Nomura et al. ..... 347/133
2001/0026310 A1 * 10/2001 Kimura ..... 347/238

FOREIGN PATENT DOCUMENTS

JP A-6-55775 3/1994
JP A-2004-66758 3/2004
JP A-2004-82330 3/2004

* cited by examiner

*Primary Examiner* — Hai C Pham
(74) *Attorney, Agent, or Firm* — Oliff & Berridge, PLC

(57) ABSTRACT

An exposure head includes a light emitting substrate having a transparent substrate, a plurality of light emitting elements that is disposed on one face of the transparent substrate, and one or a plurality of light detecting units that is disposed on the transparent substrate and can detect light emitted from the plurality of light emitting elements and propagating inside the transparent substrate. The light that is emitted from the plurality of light emitting elements and is transmitted through the transparent substrate is projected on an image carrier that faces the plurality of light emitting elements with the transparent substrate interposed therebetween so as to form a predetermined pattern on the image carrier. Inside the transparent substrate, a plurality of reformation points that diffusely reflects light propagating inside the transparent substrate is formed.

5 Claims, 12 Drawing Sheets

EXPOSURE HEAD, IMAGE FORMING UNIT, AND IMAGE FORMING APPARATUS

BACKGROUND

1. Technical Field

The present invention relates to an exposure head including a plurality of light emitting elements, an image forming unit having the exposure head, and an image forming apparatus having the exposure head.

2. Related Art

As one of exposure heads that are used in image forming apparatuses that form an image by transferring a latent image formed on the surface of a photosensitive drum by exposing the photosensitive drum to a medium such as a paper sheet through a primary transfer roller or the like, there is a type of an exposure head that uses light emitting elements regularly disposed on a substrate and gradient index lenses. In the above-described type of the exposure head, a plurality of the gradient index lenses forms images to be superposed in a same position on the surface of a photosensitive drum by using light emitted from one light emitting element, and thereby one spot is formed on the surface. By aggregating the spots, an image (latent image) is formed.

As a problem that can occur in the above-described type of the exposure head, there is a deviation of amounts of light among the plurality of light emitting elements. When a same current or voltage is applied, the intensity of light emitted from each light emitting element changes by time due to the deviation of the occurrence frequency of light emission so as to generate a deviation, and accordingly, formation of an excellent image (latent image) is hindered. In order to suppress the above-described phenomenon, for example, in an exposure head disclosed in JP-A-2004-66758, the amount of light for each light emitting element can be measured by disposing light detecting units together with the light emitting elements on a light emitting substrate.

FIGS. 16A, 16B, and 16C schematically show a light emitting substrate 300 that uses bottom-emission type organic EL elements 310 as the light emitting elements, as a light emitting substrate included in the above-described type of the exposure head, that is, a general exposure head. FIG. 16A is a top view of the light emitting substrate 300, FIG. 16B is a side view thereof, and FIG. 16C is a cross-section view taken along line XVIC-XVIC. As shown in the figures, on the periphery of the organic EL elements 310 disposed on a transparent substrate 301 in a zigzag pattern, light detecting units 320 that are formed of light receiving elements such as photo diodes as units for detecting light are disposed.

It is configured that a part of light emitted from the organic EL element 310 is repeatedly reflected between the front and rear surfaces of the transparent substrate 301 so as to reach the light detecting units 320. The amounts of light can be measured by sequentially turning on the organic EL elements 310. Then, by correcting values of the currents (or the voltages) applied to the organic EL elements 310 based on the result of measurement, an image (latent image) having high definition can be formed.

However, the above-described light emitting substrate has a problem that the ratio of light, which can be measured by the light detecting unit 320, to light emitted from the organic EL element 310 is low. In other words, as shown in FIG. 16C, the light reaching the light detecting unit 320 is limited to light L1 within the angle range θa. Thus, light beyond the angle range is emitted to the outside of the light emitting substrate 300 without reaching the light detecting unit 320. Accordingly, it is difficult to accurately acquire the aging change in the intensity of light emission of the organic EL element 310. In addition, there is a problem that accuracy of the above-described correction may decrease in a case where a complex amplification circuit, a noise reduction circuit, or the like is not used.

SUMMARY

An advantage of some aspects of the invention is that it provides an exposure head including a plurality of light emitting elements, an image forming unit having the exposure head, and an image forming apparatus having the exposure head. The invention can be implemented in the following forms or application examples.

APPLICATION EXAMPLE 1

According to Application Example 1, there is provided an exposure head having a light emitting substrate including: a transparent substrate; a plurality of light emitting elements that is disposed on one face of the transparent substrate; and one or a plurality of light detecting units that is disposed on the transparent substrate and can detect light emitted from the plurality of light emitting elements and propagating inside the transparent substrate. The light that is emitted from the plurality of light emitting elements and is transmitted through the transparent substrate is projected on an image carrier that faces the plurality of light emitting elements with the transparent substrate interposed therebetween so as to form a predetermined pattern on the image carrier. Inside the transparent substrate, a plurality of reformation points that diffusely reflects light propagating inside the transparent substrate is formed.

According to the above-described exposure head, the amount of light that is incident to the light detecting units can be increased. Accordingly, the above-described correction can be performed with high accuracy, and therefore an image (latent image) having high definition can be formed.

APPLICATION EXAMPLE 2

According to Application Example 2, in the above-described exposure head, a light reflecting layer that reflects light emitted from the plurality of light emitting elements is disposed in at least a part of an area of the surface of the transparent substrate excluding areas in which the plurality of light emitting elements is disposed, areas facing the plurality of light emitting elements, and areas in which the light detecting units are disposed.

According to the above-described exposure head, the amount of light incident to the light detecting units can be increased effectively. Accordingly, the above-described correction can be performed with higher accuracy, and therefore an image (latent image) having higher definition can be formed.

APPLICATION EXAMPLE 3

According to Application Example 3, in the above-described exposure head, the light emitting elements are organic EL elements.

According to the above-described exposure head, driving transistors formed by a TFT process and the organic EL elements can be combined on the transparent substrate, and thereby the manufacturing cost of the exposure head can be reduced.

APPLICATION EXAMPLE 4

According to Application Example 4, in the above-described exposure head, the reformation points are formed by using a laser beam.

When a laser beam is used, the above-described reformation point can be formed in an arbitrary position on the transparent substrate. Accordingly, in the above-described exposure head, the amount of light incident to the light detecting unit can be increased effectively. Therefore, the above-described correction can be performed effectively.

APPLICATION EXAMPLE 5

According to Application Example 5, in the above-described exposure head, the densities of formation of the reformation points are different in accordance with the position inside the transparent substrate.

According to the above-described exposure head, for example, by forming the reformation points at high density near the light detecting unit, the amount of light incident to the light detecting unit can be increased effectively. Accordingly, while the manufacturing cost of the above-described exposure head is reduced, the above-described correction can be performed effectively.

APPLICATION EXAMPLE 6

According to Application Example 6, there is provided an image forming unit including the above-described exposure head.

According to the above-described image forming unit, an image (latent image) having high definition can be formed on the image carrier, and accordingly, the quality of an image formed in a medium such as a paper sheet can be improved.

APPLICATION EXAMPLE 7

According to Application Example 7, there is provided an image forming apparatus including the above-described exposure head.

According to the above-described image forming apparatus, an image (latent image) having high definition can be formed on the image carrier, and accordingly, the quality of an image formed in a medium such as a paper sheet can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
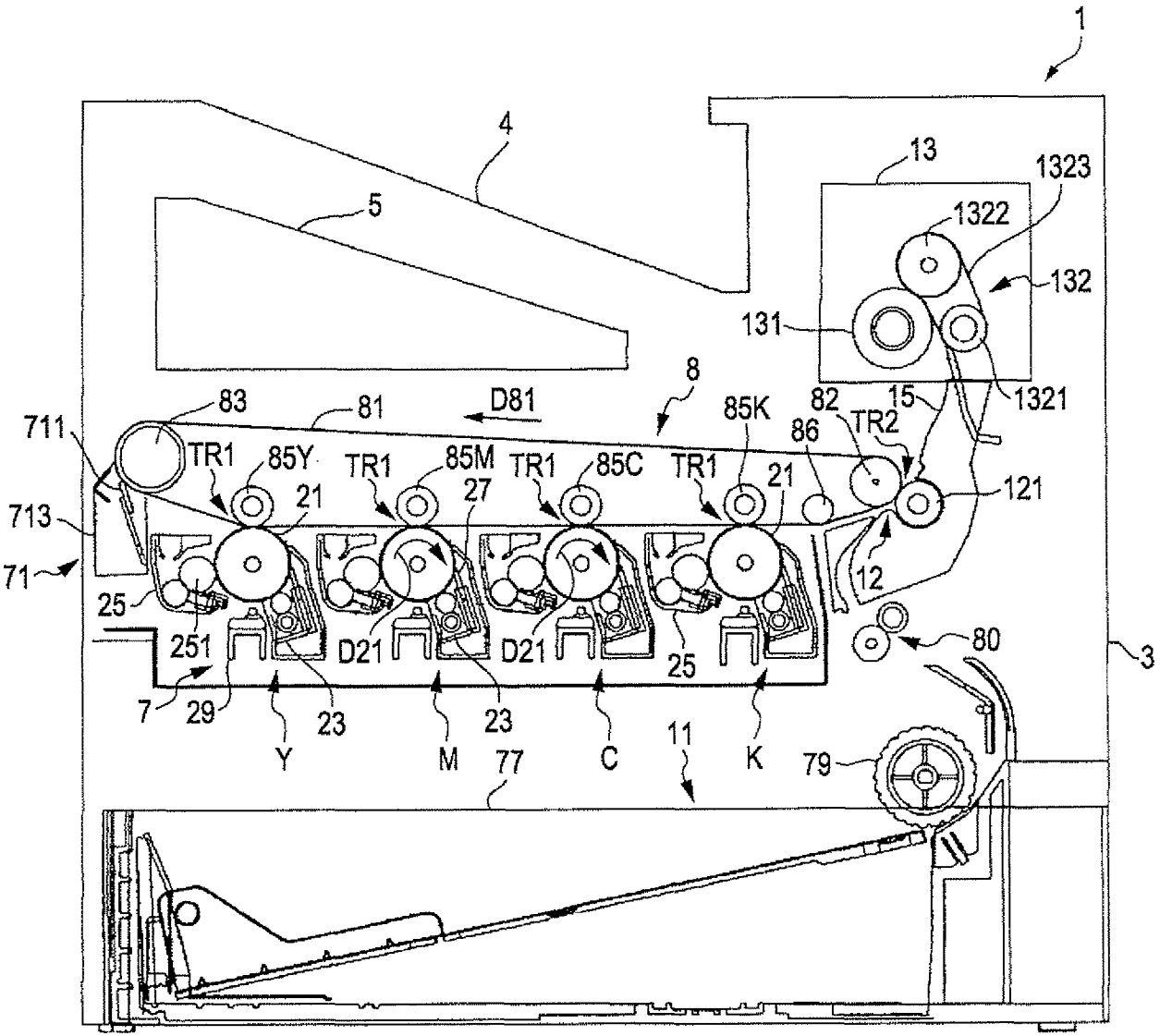
FIG. 1 is a diagram showing an image forming apparatus in which an exposure head according to a first embodiment of the invention can be used.

Hereinafter, liquid crystal devices according to embodiments of the invention as electro-optical devices will be described with reference to the accompanying drawings. In drawings below, in order to have the size of each element to be recognizable in the drawings, the size or ratio of the element is appropriately changed from its real size or ratio.

First Embodiment

FIGS. 1 to 4 show an exposure head according to a first embodiment of the invention, an image forming unit including the exposure head, and an image forming apparatus 1 including the image forming unit.

Figure 2:
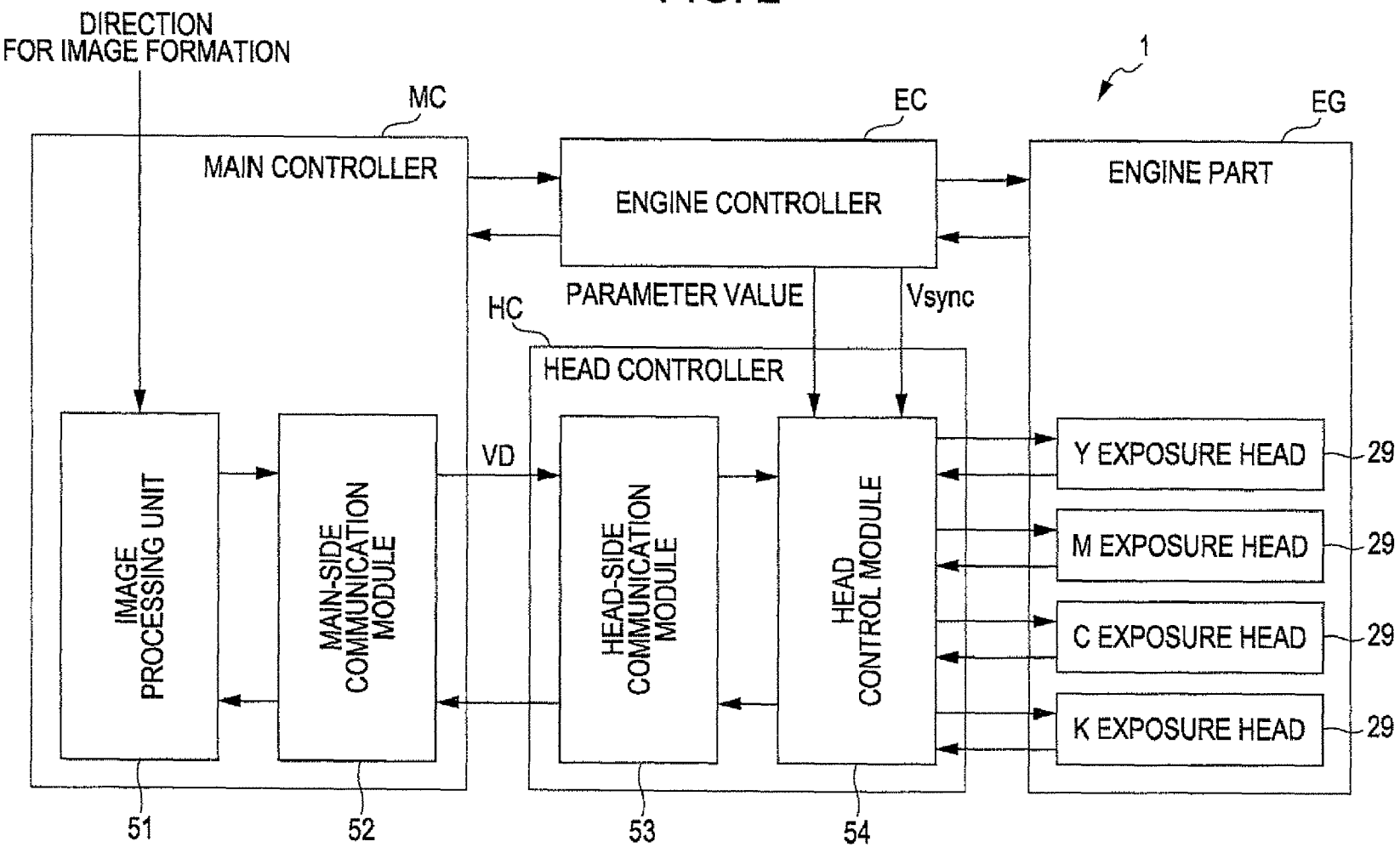
FIG. 2 is a diagram showing the electrical configuration of the image forming apparatus according to the first embodiment.

FIG. 1 is a diagram showing the image forming apparatus 1 in which the exposure head 29 according to the first embodiment can be used. FIG. 2 is a diagram showing the electrical configuration of the image forming apparatus 1 shown in FIG. 1. This image forming apparatus 1 can selectively activate a color mode for forming a color image by overlapping toner of four colors including black (K), cyan (C), magenta (M), and yellow (Y) colors and a monochrome mode for forming a monochrome image by only using the toner of the black (K) color.

In addition, FIG. 1 is a diagram corresponding to activation of the color mode. In the image forming apparatus 1, when a direction for image formation is transmitted to a main controller MC that has a CPU, a memory, and the like from an external apparatus such as a host computer, the main controller MC transmits a control signal or the like to an engine controller EC and transmits video data VD corresponding to the direction for image formation to a head controller EC. This head controller HC controls exposure heads 29 of colors based on the video data VD transmitted from the main controller MC, a vertical synchronization signal Vsync and a parameter value transmitted from the engine controller EC. Accordingly, an engine part EG forms an image corresponding to the direction for image formation on a sheet such as a copy sheet, a transfer sheet, a paper sheet, or a transparent OHP sheet by performing a predetermined image forming operation.

In a housing main body 3 that is included in the image forming apparatus according to this embodiment, an electric component box 5 in which a power supply circuit substrate, the main controller MC, the engine controller EC, and a head controller HC are disposed. In addition, an image forming unit 7, a transfer belt unit 8, and a paper feed unit 11 are installed inside the housing main body 3. On the right side of the inside of the housing main body 3 in FIG. 1, a secondary transfer unit 12, a fixing unit 13, and a sheet guiding member 15 are installed. The paper feed unit 11 is detachably attached to the main body of the image forming apparatus 1. In addition, the paper feed unit and the transfer belt unit 8 are configured to be separately fixable and replaceable.

The image forming unit 7 includes four image forming stations Y (for yellow), M (for magenta), C (for cyan), and K (for black) that form a plurality of images in different colors. In addition, each image forming station Y, M, C, or K includes a photosensitive drum 21 having a cylindrical shape that has a surface of a predetermined length in the main scanning direction MD (see FIG. 3). In addition, each image forming station Y, M, C, or K forms a toner image of a corresponding color on the surface of the photosensitive drum 21. The photosensitive drum 21 is disposed to have the direction of the shaft to be approximately parallel to the main scanning direction MD. In addition, each photosensitive drum 21 is connected to a dedicated driving motor thereof and is driven to rotate at a predetermined speed in the rotation direction D21 (the direction of an arrow shown in FIG. 1). Accordingly, the surface of the photosensitive drum 21 is transported in the sub scanning direction SD (see FIG. 4) that is approximately perpendicular to the main scanning direction MD. In addition, on the periphery of the photosensitive drum 21, a charging part 23, and exposure head 29, a developing part 25, and a photosensitive body cleaner 27 are disposed in the direction of rotation. By these functional parts, a charging operation, a latent image forming operation, and a toner developing operation are performed. Accordingly, in the color mode, a color image is formed by superposing the toner images formed by all the image forming stations Y, M, C, and K on a transfer belt 81 that is included in the transfer belt unit 8. On the other hand, in the monochrome mode, a monochrome image is formed by using only the toner image that is formed by the image forming station K. As shown In FIG. 1, since the configurations of the image forming stations of the image forming unit 7 are the same, for the convenience of drawing, reference signs are attached to only a part of the image forming stations, and reference signs for the other image forming stations are omitted.

The charging part 23 includes a charging roller of which surface is formed of elastic rubber. This charging roller is configured to be driven to rotate by being brought into contact with the surface of the photosensitive drum 21 in a charging position and is driven to rotate in the driven direction with respect to the photosensitive drum 21 at a circumferential velocity in accordance with the rotation of the photosensitive drum 21. In addition, the charging roller is connected to a charging bias generating part (not shown). The charging roller charges the surface of the photosensitive drum 21 in a charging position in which the charging part 23 and the photosensitive drum 21 are brought into contact with each other by being supplied with electricity of the charging bias from the charging bias generating part.

The exposure head 29 is disposed with respect to the photosensitive drum 21 such that the longitudinal direction of the exposure head 29 is in correspondence with the main scanning direction MD and the width direction of the exposure head 29 is in correspondence with the sub scanning direction SD. Accordingly, the longitudinal direction of the exposure head 29 is approximately parallel to the main scanning direction MD. In addition, the exposure head 29 includes a plurality of light emitting elements that is disposed to be parallel to the longitudinal direction and is disposed to be spaced apart from the photosensitive drum 21. By projecting (that is, by exposing) light from the light emitting elements to the surface of the photosensitive drum 21 that is charged by the charging part 23, a latent image is formed on the surface. In addition, according to this embodiment, in order to control the exposure heads 29 of each color, the head controller HC is disposed. The head controller HC controls the exposure heads 29 based on the video data VD from the main controller MC and signals transmitted from the engine controller EC. In other words, according to this embodiment, image data included in the image forming direction is input to an image processing unit 51 of the main controller MC. Then, various image processes are performed for the image data so as to generate the video data VD of each color, and the video data VD is transmitted to the head controller HC through the main-side communication module 52. In addition, from the head controller HC, the video data VD is transmitted to the head control module 54 through the head-side communication module 53. This head control module 54, as described above, is supplied with a signal representing a parameter value related to formation of the latent image and the vertical synchronization signal (Vsync) by the engine controller EC. Then, based on these signals, the video data VD, and the like, the head controller HC generates signals that are used for controlling driving of the elements of the exposure heads 29 of each color and outputs the signals to the exposure heads 29. Accordingly, the operation of the light emitting elements of the exposure heads 29 are appropriately controlled, and latent images that are in correspondence with the direction for image formation are formed.

According to this embodiment, the photosensitive drum 21, the charging part 23, the developing part 25, and the photosensitive body cleaner 27 of each image forming station Y, M, C, or K are configured as a unit of a photosensitive cartridge. In each photosensitive cartridge, a nonvolatile memory that is used for storing information on the photosensitive cartridge is disposed. Between the engine controller EC and each photosensitive cartridge, wireless communication is performed. Accordingly, the information on each photosensitive cartridge is transferred to the engine controller EC, and information stored in each memory is updated to be stored.

The developing part 25 has a developing roller 251 on which surface toner is carried. Then, by application of a developing bias applied to the developing roller 251 from the developing bias generating part (not shown) that is electrically connected to the developing roller 251, the charged toner is moved from the developing roller 251 to the photosensitive drum 21 in the developing position in which the developing roller 251 and the photosensitive drum 21 are brought into contact with each other. Thereby, the latent image that is formed by the exposure head 29 is exposed.

After the toner image exposed in the developing position as described above is transported in the direction D21 of rotation of the photosensitive drum 21, the toner image is transferred in a primary transfer position TR1 of the transfer belt 81, in which the transfer belt 81 to be described in detail later and each photosensitive drum 21 are brought into contact with each other, as primary transfer.

In addition, in this embodiment, the photosensitive body cleaner 27 is disposed to be brought into contact with the surface of the photosensitive drum 21 in a position that is located on the downstream side of the primary transfer position TR1 of in the direction D21 of rotation of the photosensitive drum 21 and the upstream side of the charging part 23. This photosensitive body cleaner 27 is brought into contact with the surface of the photosensitive drum so as to remove toner that remains on the surface of the photosensitive drum 21 after the primary transfer as a cleaning process.

The transfer belt unit 8 includes a driving roller 82, a driven roller 83 (blade opposing roller) that is disposed on the left side of the driving roller 82 in FIG. 1, and a transfer belt 81 that is stretched between the rollers and is driven to circulate in the direction (transport direction) of an arrow D81 shown in the figure. In addition, the transfer belt unit 8 includes, on the inner side of the transfer belt 81, four primary transfer rollers 85Y, 85M, 85C, and 85K that are disposed to face the photosensitive drums 21 included in the image forming stations Y, M, C, and K for one-to-one matching at the time of installation of the photosensitive cartridges. The primary transfer rollers 85 are electrically connected to the primary transfer bias generating part (not shown). Then, as described later in detail, in the color mode, the transfer belt 81 is pressed to be brought into contact with the photosensitive drums 21 included in the image forming stations Y, M, C, and K so as to form the primary transfer position TR1 between each photosensitive drum 21 and the transfer belt 81 by positioning all the primary transfer rollers 85Y, 85M, 85C, and 85K on the sides of the image forming stations Y, M, C, and K as shown in FIG. 1. Then, by applying primary transfer biases to the primary transfer rollers 85 from the primary bias generating part at an appropriate timing, the toner images formed on the surfaces of the photosensitive drums 21 are transferred to the corresponding primary transfer positions TR1 on the surface of the transfer belt 81, and thereby a color image is formed.

On the other hand, in the monochrome mode, by having the color primary transfer rollers 85Y, 85N, and 85C of four primary transfer rollers 85 spaced apart from the opposing image forming stations Y, M, and C and bringing only the primary transfer roller 85K into contact with the image forming station K, only the monochrome image forming station K is brought into contract with the transfer belt 81. As a result, the primary transfer position TR1 is formed only between the monochrome primary transfer roller 85K and the image forming station K. Then, by applying a primary transfer bias to the monochrome primary transfer roller 85K from the primary transfer bias generating part at an appropriate timing, the toner images formed on the surfaces of the photosensitive drums 21 are transferred to the primary transfer position TR1 of the transfer belt 81 and thereby a monochrome image is formed.

In addition, the transfer belt unit 8 includes a downstream guide roller 86 that is disposed on the downstream side of the monochrome primary transfer roller 85K and the upstream side of the driving roller 82. This downstream guide roller 86 is configured to be brought into contact with the primary transfer position TR1, which is formed by bringing the monochrome primary transfer roller 85K into contact with the photosensitive drum 21 of the image forming station K, of the transfer belt 31, on the internal common tangent of the primary transfer roller 85K and the photosensitive drum 21.

The driving roller 82 drives the transfer belt 81 to circulate in the direction of an arrow D81 shown in the figure and also serves as a backup roller of a secondary transfer roller 121. On the peripheral face of the driving roller 82, a rubber layer having a thickness of about 3 mm and a volume resistivity equal to or smaller than 1000 kΩ·cm is formed. By grounding the driving roller 82 through a metal shaft, the driving roller 82 becomes a conduction path of a secondary transfer bias that is supplied through a secondary transfer roller 121 from a secondary transfer bias generating part not shown in the figure. By disposing the rubber layer having a high frictional property and a shock absorbing property in the driving roller 82 as described above, shock at a time when a sheet enters into a contact portion (a secondary transfer position TR2) of the driving roller 82 and the secondary transfer roller 121 cannot be easily delivered to the transfer belt 81, and accordingly, degradation of the image quality can be prevented.

The paper feed unit 11 includes a paper feed part that has a paper feed cassette 77 that can laminate and hold sheets and a pickup roller 79 that feeds sheets from the paper feed cassette 77 one by one. A sheet fed from the paper feed part by the pickup roller 79 is fed to the secondary transfer position TR2 along the sheet guiding member 15 after the feed timing thereof is adjusted by a resist roller pair 80.

The secondary transfer roller 121 is disposed to be able to be separated from or brought into contact with the transfer belt 81 and is driven to be separated from or brought into contact with the transfer belt 81 by a secondary transfer roller driving mechanism (not shown). The fixing unit 13 includes a heating roller 131 that has a heating body such as a halogen heater therein and can rotate and a pressing part 132 that presses and biases the heating roller 131. Then, the sheet, to the surface of which the image is transferred as secondary transfer is guided to a nip part that is formed by the heating roller 131 and the pressing belt 1323 of the pressing part 132 by the sheet guiding member 15. An image is fixed by using heating in the nip part at a predetermined temperature. Then, the pressing part 132 is configured by two rollers 1321 and 1322 and a pressing belt 1323 that is stretched between the rollers. The pressing part 132 is configured such that the nip part that is formed by the heating roller 131 and the pressing belt 1323 is enlarged by pressing a belt expansion face, which is expanded by two rollers 1321 and 1322, of the surface of the pressing belt 1323 to the peripheral face of the heating roller 131. Then, the sheet for which the fixing process is performed as described above is transported to a paper discharge tray 4 that is disposed in the top face part of the housing main body 3.

In addition, in this apparatus, a cleaner part 71 is installed to face the driven roller 83. The cleaner part 71 includes a cleaner blade 711 and a waste toner box 713. The cleaner blade 711 removes foreign materials such as toner or paper powders remaining on the transfer belt after the secondary transfer by bringing the front end portion thereof into contact with the driven roller 83 through the transfer belt 81. Then, the foreign materials as described above are collected into the waste toner box 713. The cleaner blade 711 and the waste toner box 713 are integrally formed with the driven roller 83. Accordingly, when the driven roller 83 is moved as described next, the cleaner blade 711 and the waste toner box 713 are moved together with the driven roller 83.

Figure 3:
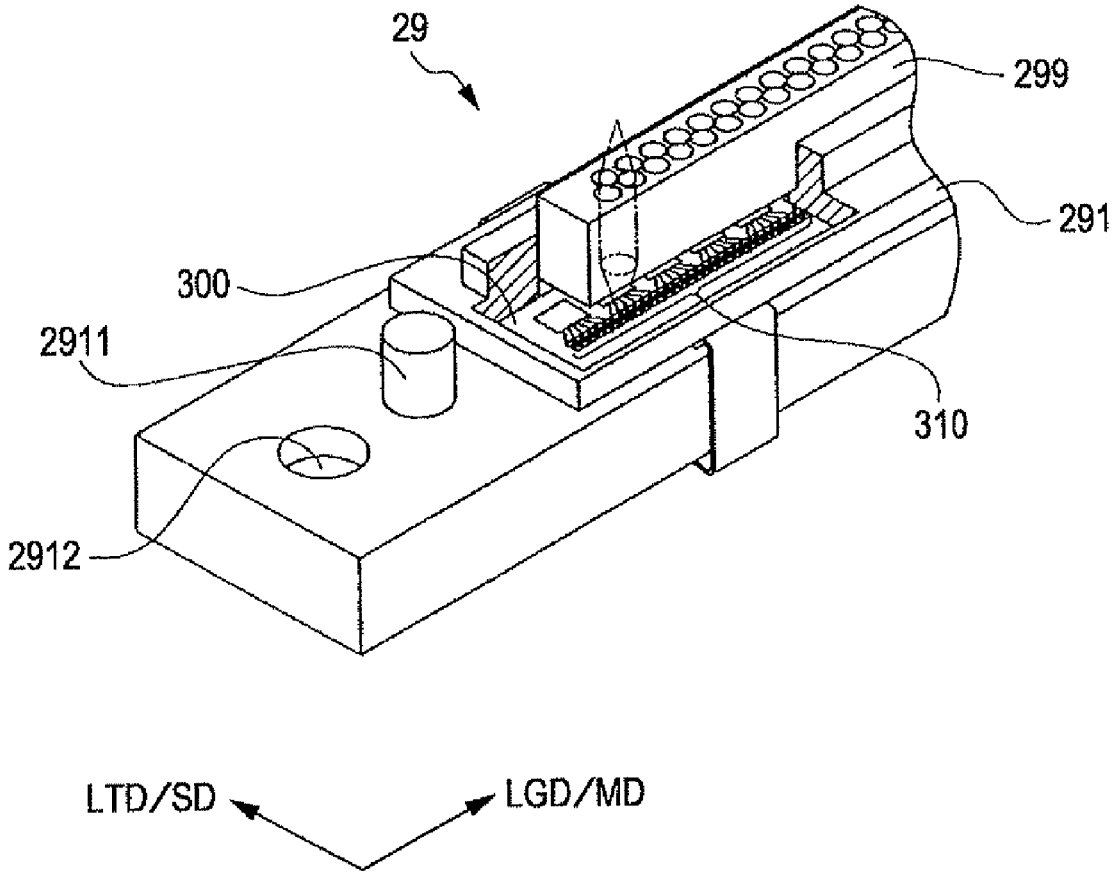
FIG. 3 is a perspective view showing an overview of an exposure head according to the first embodiment.
Figure 4:
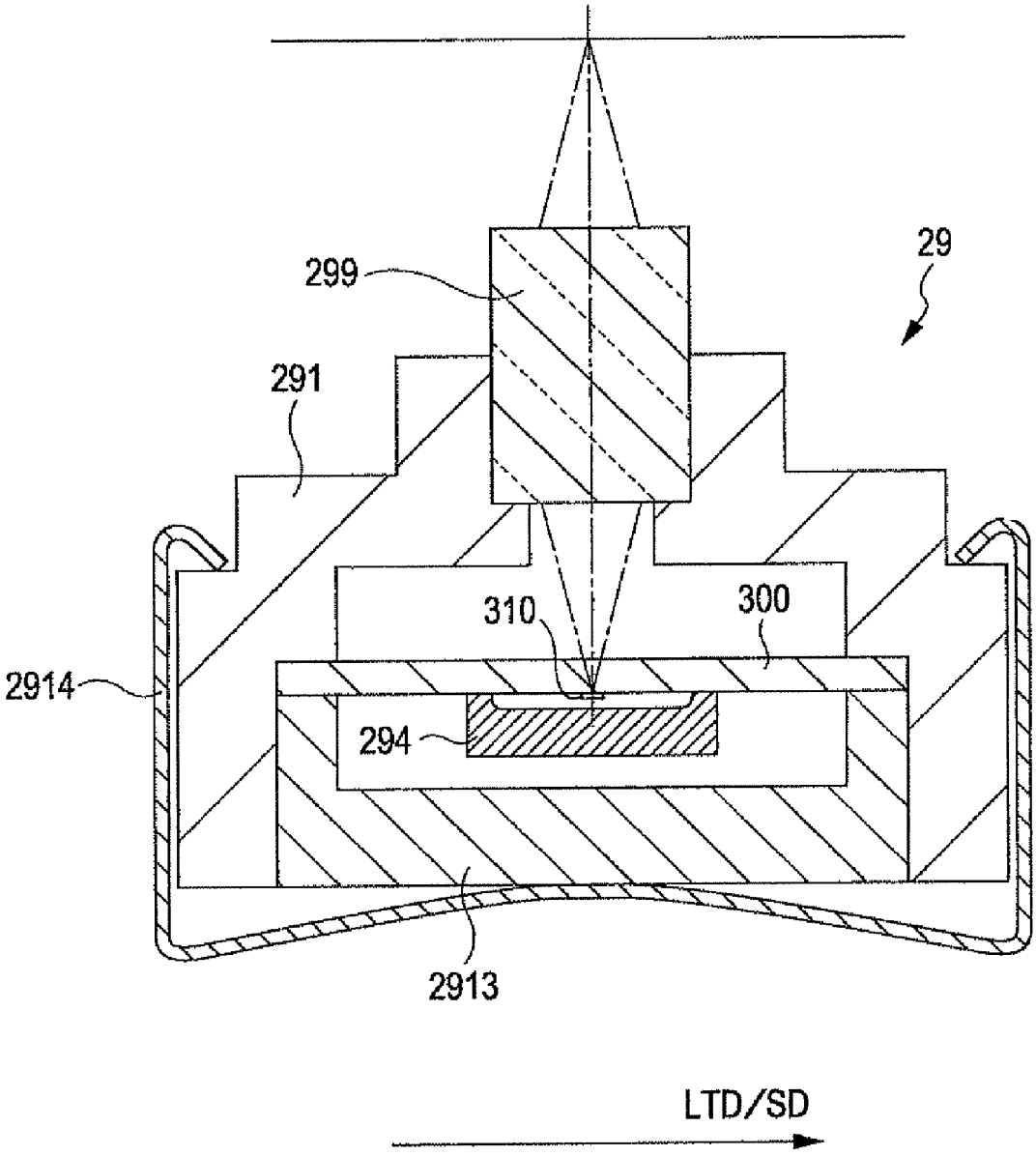
FIG. 4 is a cross-section view of the exposure head according to the first embodiment in the width direction.

FIG. 3 is a perspective view of an exposure head according to this embodiment. In addition, FIG. 4 is a cross-section view of the exposure head shown in FIG. 3 in the width direction. As described above, the exposure head 29 is disposed with respect to the photosensitive drum 21 such that the longitudinal direction LGD thereof is in correspondence with the main scanning direction MD and the width direction LTD thereof is in correspondence with the sub scanning direction SD. In addition, the longitudinal direction LGD and the width direction LTD are approximately perpendicular to each other. The exposure head 29 according to this embodiment includes a case 291. In both ends of the case 291 in the longitudinal direction LGD, a position determining pin 2911 and a screw inserting hole 2912 are disposed. The exposure head 29 is positioned with respect to the photosensitive drum 21 by inserting the position determining pin 2911 into a position determining hole (not shown) that is punched in a photosensitive body cover (not shown) that covers the photosensitive drum 21 and is positioned with respect to the photosensitive drum 21. Then, by inserting a fixing screw into a screw hole (not shown) of the photosensitive body cover so as to be fixed through the screw inserting hole 2912, the exposure head 29 is positioned and fixed with respect to the photosensitive drum 21.

The case 291 holds a lens array 299 in a position for facing the surface of the photosensitive drum 21 and includes a light emitting substrate 300 facing the lens array therein. The lens array 299 is configured by disposing a plurality of gradient index lenses in a zigzag pattern and forms an image of light emitted from organic EL elements 310 on the photosensitive drum 21.

The light emitting substrate 300 is formed by a transparent substrate 301 (see FIG. 5) formed of a transparent material such as glass, a plurality of the organic EL elements 310 as light emitting elements that are disposed in a zigzag pattern (in the longitudinal direction) on a rear face (a face located on the opposite side of the face facing the lens array 299) of the transparent substrate, and the like. The light emitting substrate 300 is driven by a driving circuit, not shown in the figure, that is disposed on the rear face and emits light toward the direction of the lens array 299. Then, the light is imaged on the surface of the photosensitive drum 21 by the lens array 299 as a spot.

In addition, the lens array 299 is configured by piling a plurality of gradient index lenses having a same shape in two steps. The lens array 299 is configured in correspondence with the disposition of the organic EL elements 310 on the light emitting substrate 300 to be described later, and the cross-section of the lens array 299 vertical to the light axis is in a state in which a circular cross-section is aligned in two rows in the zigzag pattern.

As shown in FIG. 4 (the cross-section view in the width direction), a rear cover 2913 is pressed to the case 291 through the light emitting substrate 300 by a fixing mechanism 2914. In other words, the fixing mechanism 2914 has an elastic force for pressing the rear cover 2913 to the case 291 side and presses the rear cover by the elastic force so as to shield the inside of the case 291 densely for light (that is, the inside of the case 291 is shielded such that light does not leak from the inside of the case 291 and light is not penetrated from the outside of the case 291). The fixing mechanism 2914 is disposed in a plurality of spots in the longitudinal direction (LCD) of the case 291. In addition, the organic EL element 310 is covered with a sealing member 294.

Figure 5A:
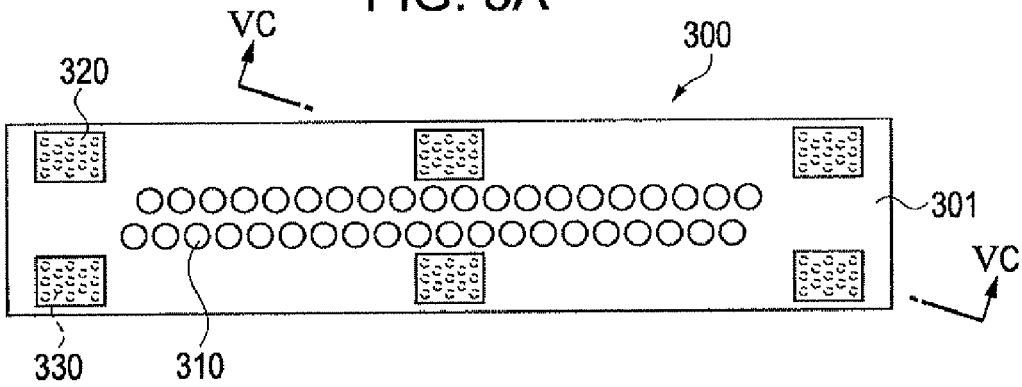
FIGS. 5A, 5B, 5C, and 5D are schematic diagrams showing a light emitting substrate according to the first embodiment.
Figure 5B:
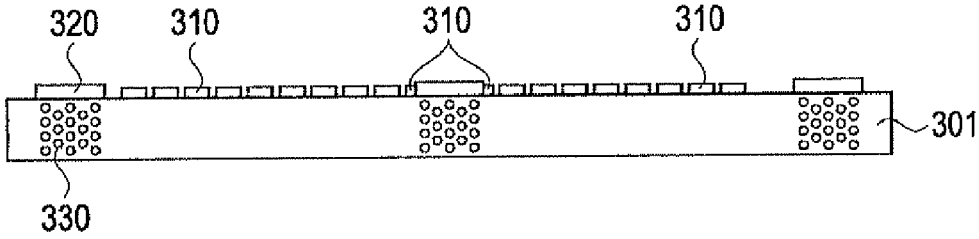
Figure 5C:
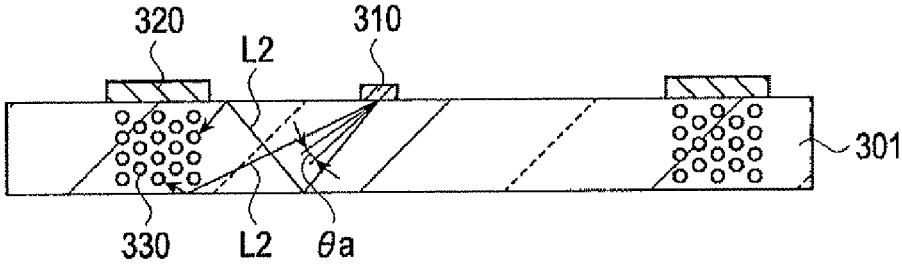
Figure 5D:
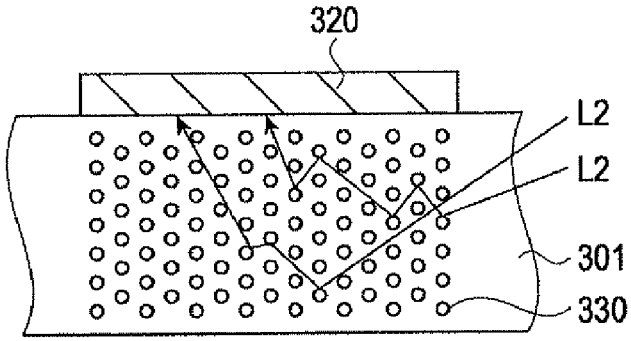

FIGS. 5A, 5B, 5C, and 5D are schematic diagrams showing the light emitting substrate 300 according to this embodiment. FIG. 5A is a plan view viewed from the direction of the above-described rear face, and FIG. 5B is a side view. FIG. 5C is an enlarged diagram taken along line VC-VC shown in FIG. 5A, and FIG. 5D is an enlarged diagram of a portion in which a reformation point 330 to be described later is formed.

As shown in FIGS. 5A and 5B, the light emitting substrate 300 is formed by a transparent substrate 301, a plurality of organic EL elements 310 that is disposed on the rear face of the transparent substrate 301 in a zigzag pattern, a plurality of light detecting units 320 (formed of light receiving elements such as photodiodes) that is disposed on the periphery of the organic EL elements, and the like. In FIGS. 5A to 5D and FIGS. 7 to 12 to be described later, only a part of the organic EL elements 310 is shown.

In the thickness direction of an area in which each light detecting unit 320 of the transparent substrate 301 is disposed, a plurality of reformation points 330 that hinder the direct advance of light is formed. The reformation point 330 is an air bubble, a crack, or a structural defect, or the like formed in glass or the like that is the material of formation of the transparent substrate 301 and can hinder the direct advance of light. Accordingly, as shown in FIG. 5C, by reflecting light L2 beyond the range of an angle range θa, that is, light that is not incident to the light detecting unit 320 in a general light emitting substrate or the like, the direction of advance can be changed. The above-described reflection or the like occurs not once but many times consecutively. Accordingly, the light projected to the area in which the above-described light detecting unit 320 is disposed does not advance straight and repeats diffuse reflection.

FIG. 5D shows the form of the above-described diffuse reflection. Since the plurality of the reformation points 330 is formed to be densely disposed, the light L2 incident to the above-described area continues diffuse reflection until the light is incident to the light detecting unit 320 or reaches an area other than the above-described area. Accordingly, by forming the reformation points 330, at least a part of light that does not incident to the light detecting unit 320 in a general light emitting substrate can be incident to the light detecting unit 320. Therefore, the ratio of light incident to the light detecting unit 320 to light emitted from the organic EL element 310 can be increased.

As described above, in the light emitting substrate 300 that forms a latent image on the photosensitive drum 21 by using the organic EL element 310 that is disposed in the longitudinal direction LGD (see FIG. 3), a deviation of the degree of aging degradation is generated in accordance with the frequency of light emission of each organic EL element 310. Thus, in order to form a high-definition image, the light emitting intensity of each organic EL element 310 is needed to be measured and corrected on a regular time basis. The image forming unit 7 and the image forming apparatus 1 that use the light emitting substrate 300 according to this embodiment can increase the amount of light incident to the light detecting units in a case where the form of disposition of the organic EL elements 310, the light detecting units 320, and the like is the same as that of a general light emitting substrate and the like. Accordingly, the aging degradation of the intensity of light emission of each organic EL element 310 can be acquired more accurately without using a complex amplification circuit, a noise reduction circuit, or the like, and thus the amplitude of a current applied to each organic EL element or the like can be corrected more accurately. Thereby, an image that is more accurate can be formed in spite of the aging degradation.

As shown in the figure, a plurality of the light detecting units 320 is disposed in one light emitting substrate 300. Thus, light emitted from one organic EL element is incident to all the plurality of the light detecting units 320 (the amounts of incident light are different from one another in accordance with the positions of the light emitting units 320). Thus, a measured value (Phn to be described later) by using the light detecting units 320 is a sum of measured values of all the light detecting units 320.

The above-described correction process is performed as follows. First, in a stage (a stage before the exposure head 29 is installed to the image forming apparatus) in which the exposure head 29 is formed, light is emitted from the organic EL elements 310, and the amount of light of a spot that is formed in a position corresponding to the surface of the photosensitive drum 21 is measured for each organic EL element 310. In particular, the exposure head 29 is attached to the test device. In the test device, a light-amount detector that detects the amount of light emitted from each organic EL element 310 of the exposure head 29 in a position of the top face corresponding to the surface of the photosensitive drum 21 is disposed. This light-amount detector may be configured such that the amount of light emitted from each organic EL element 310 is detected while one detector is moved, or the light-amount detector may be configured such that the detector is disposed for each organic EL element 310. Then, the organic EL elements 310 are sequentially emitted, and a detected value Pgn by using the light-amount detector of the test device and a detected value Phn (here, n denotes the n-th light emitting element) detected by using the light detecting unit 320 of the exposure head 29 are acquired. Then, a correction coefficient Pgn/Phn is calculated for each organic EL element 310. The correction coefficient Pgn/Phn acquired as described above, for example, is stored in the engine controller EC shown in FIG. 2. Then, as described next, a correction process of the image forming apparatus is performed based on the correction coefficient Pgn/Phn.

In the correction process of the image forming apparatus 1, first, the deviation of the amounts of the organic EL elements 310 is detected. The detection of the deviation of amounts of light is performed in a time period during which an ordinary image forming operation is not performed such as in a time period when power is input to the image forming apparatus or a time period before start of the image forming operation. In particular, detected values of the light detecting unit 320 are measured while the organic EL elements 310 are sequentially emitted. Then, by multiplying the measured values of the light detecting unit 320 by the correction coefficients Pgn/Phn, the amounts of light in the spot formed on the surface of the photosensitive drum 21 by the organic EL elements 310 are calculated. When there is a deviation of the calculated amounts of light and desired amounts of light are not implemented, driving of the organic EL elements 310 is controlled so as to acquire the desired amounts of light. In other words, the desired amount of light and the calculated amount of light are compared with each other, and a current flowing through the organic EL element 310 or the like is adjusted, so that the calculated amount of light becomes the desired amount of light. Then, by performing this adjustment operation for all the organic EL elements 310, the deviation of the amounts of light among the plurality of the organic EL elements 310 is suppressed. As a result, excellent exposure is implemented. The information on the desired amount of light or a program used for performing the driving control operation, and the like, for example, may be stored in the engine controller EC in advance.

Figure 6A:
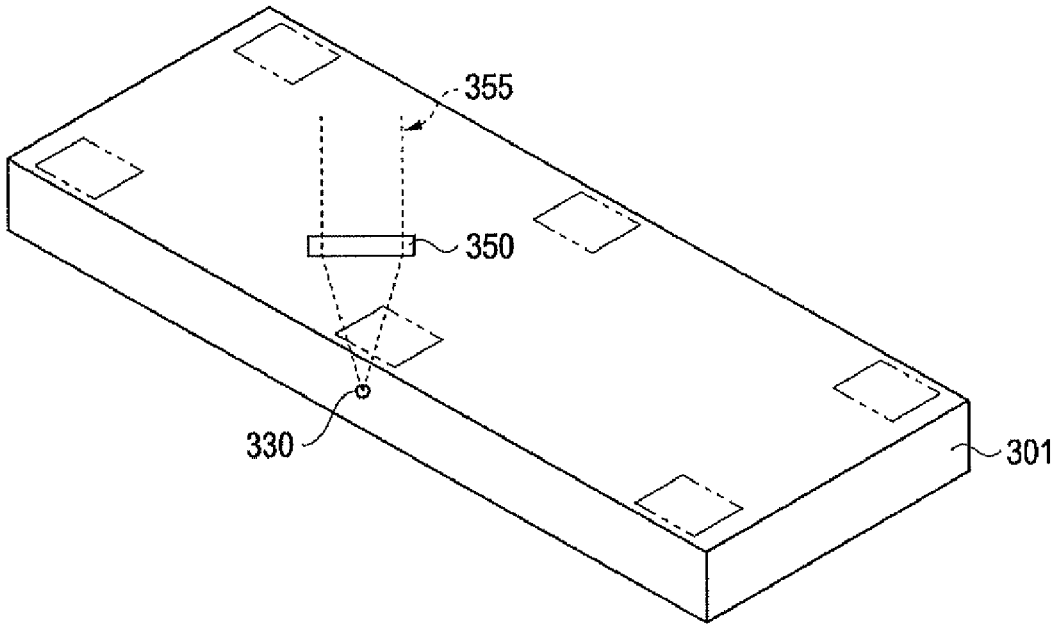
FIGS. 6A and 6B are diagrams showing an example of a method of forming reformation points.
Figure 6B:
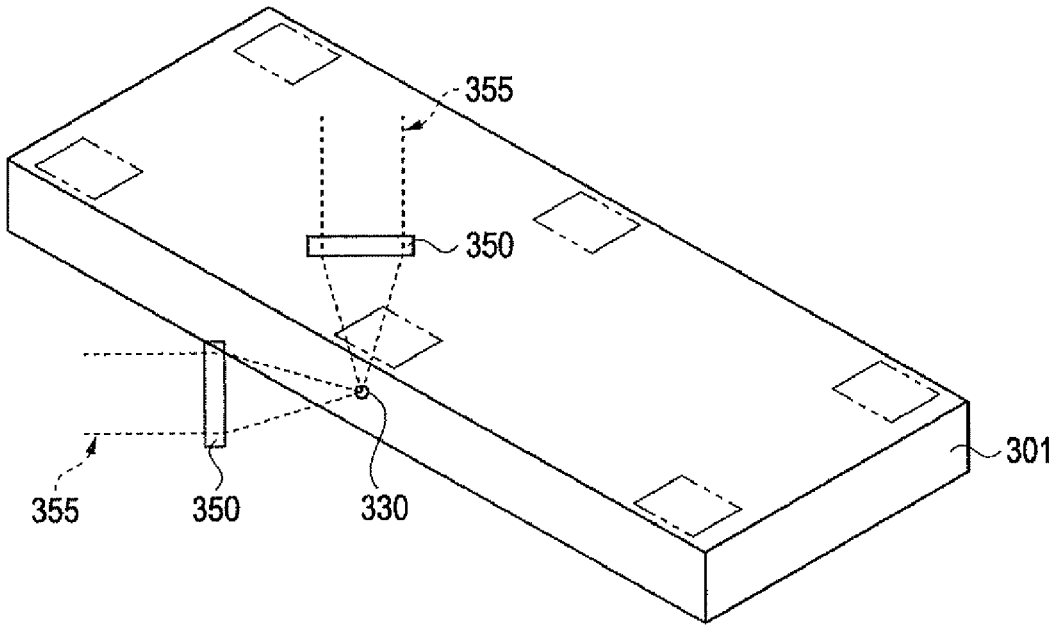

Next, the method of forming the reformation point 330 will be described. FIGS. 6A and 6B show an example of the method of forming the reformation point 330 and show a form in which the reformation point is formed in the transparent substrate 301 by using a laser beam 355. As shown in FIG. 6A, by collecting a laser beam 355 having a predetermined diameter which is emitted from a light source not shown in the figure to one point inside the transparent substrate 301 by using a light collecting lens 350, an air bubble, a crack, or the like is formed in the one point without affecting the peripheral characteristics (transparency or the like) can be used as the reformation point 330. Then, by relatively moving the light source not shown in the figure, a unit having the light collecting lens 350, and the transparent substrate 301, a plurality of the reformation points 330 can be formed in any portion inside the transparent substrate 301.

FIG. 6B is a diagram showing a form in which the reformation point 330 is formed by using two sets of units each including the above-described light source and the light collecting lens 350. By collecting two sets of the laser beams 355 to a same point, energy having a higher level can be concentrated to one point. Accordingly, one point inside the transparent substrate can be reformed in a short time period without affecting the peripheral characteristics. Three or more sets of the units can be used. In addition, the reformation point 330 can be formed at any time point such as a time point before the organic EL element is formed on the transparent substrate 301 or a time point thereafter.

It is preferable that the laser beam 355 is the second harmonics (wavelength=532 nm) of the YAG laser or the third harmonics (wavelength=355 nm) of the YAG laser. In such a case, since the laser beam has a long pulse width, the formed reformation point 330 is in the shape of a crack, and accordingly, the light emitted from the organic EL element can be reflected in an effective manner In addition, a titan sapphire solid femtosecond laser (wavelength=800 nm) may be used.

Second Embodiment

Subsequently, a second embodiment of the invention will be described. A light emitting substrate 300 according to the second embodiment and light emitting substrates 300 according to third to seventh embodiments to be described later, similarly to the light emitting substrate 300 according to the first embodiment, is combined with the lens array 299 and the like so as to form an exposure head 29 and additionally becomes a constituent element of the image forming unit 7 and the image forming apparatus 1. In this case, the constituent elements including the lens array 299 and the like are common except for the light emitting substrate 300. Thus, in this embodiment and the third to seventh embodiments, only the light emitting substrate 300 will be described.

Figure 7A:
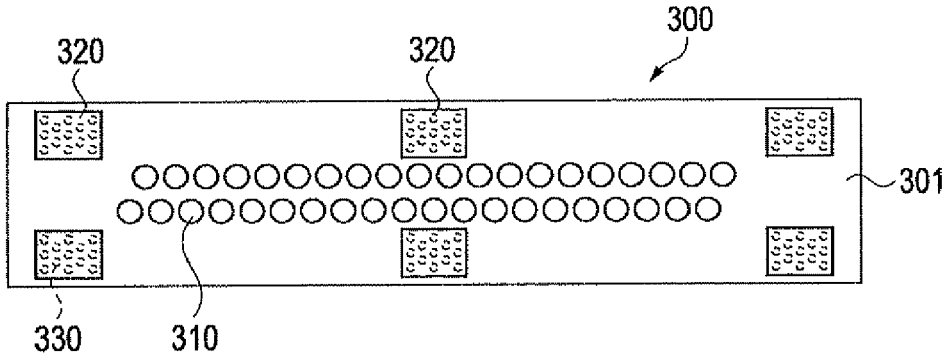
FIGS. 7A and 7B are schematic diagrams showing a light emitting substrate according to a second embodiment of the invention.
Figure 7B:
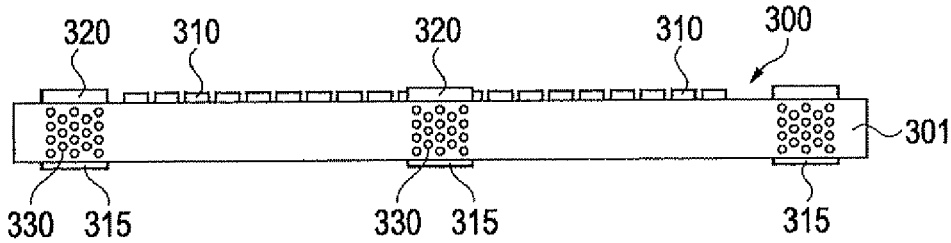

FIGS. 7A and 7B are diagrams showing a light emitting substrate 300 according to the second embodiment. FIG. 7A is a plan view thereof, and FIG. 7B is a side view thereof. The configuration of the light emitting substrate 300 is common to the light emitting substrate according 300 to the first embodiment except for the light emitting substrate of the first embodiment and inclusion of the light reflecting layer to be described later. In other words, the light emitting substrate 300 is configured by the organic EL elements 310 as light emitting elements that are disposed on the transparent substrate 301 in a zigzag pattern, the light detecting units 320 disposed on the periphery of the organic EL elements, and the like. In addition, in the thickness direction of an area in which each light detecting unit 320 of the transparent substrate 301 is disposed, a plurality of reformation points 330 that hinders the direct advance of light is formed. In addition, in each area, which faces the light detecting unit 320, of the bottom face of the transparent substrate 301, a light reflecting layer 315 is disposed. The light reflecting layer 315 is formed of metal such as aluminum that has high reflectivity. As the method of forming the light reflecting layer, a film may be formed by using a sputtering method or the like, or a metal plate may be bonded.

Under the above-described configuration, the light that advances toward the outside of the transparent substrate 301 after being reflected from the reformation point 330 can be returned to the area, in which the reformation point 330 is formed, to be reflected diffusely again. Accordingly, the ratio of light incident to the light detecting unit to light emitted from the organic EL element 310 can be increased without changing the size of the light detecting unit 320 or the like. Therefore, the degree of aging degradation of each organic EL element 310 can be acquired much more accurately, and thus, a much more accurate correction (adjustment) process can be performed. Thereby, an image that is much more accurate can be formed. The light reflecting layer 315 may be a mirror-finished reflection layer or a diffuse reflection layer.

In FIG. 7, although the shape of the light reflecting layer 315 (the shape viewed in a plane) is shown to be approximately the same as that of the light detecting unit 320, the shape of the light reflecting layer 315 is not limited thereto. In addition, the disposed position of the light reflecting layer 315 is not limited to the bottom face (a face opposing a face on which the organic EL element 310 is formed) of the transparent substrate 301. The light reflecting layer 315 may be disposed in the entire area except for an area in which the organic EL element 310 is formed and an area overlapped with the path of light that is emitted from the organic EL element 310 and is incident to the lens array 299. Accordingly, the light reflecting layer 315 may be disposed on a side face (a face other than the top face and the bottom face) of the transparent substrate 301.

Third Embodiment

Figure 8A:
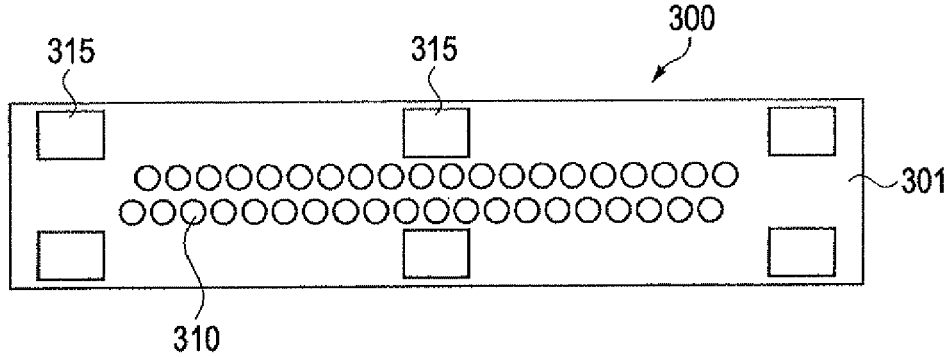
FIGS. 8A and 8B are schematic diagrams showing a light emitting substrate according to a third embodiment of the invention.
Figure 8B:
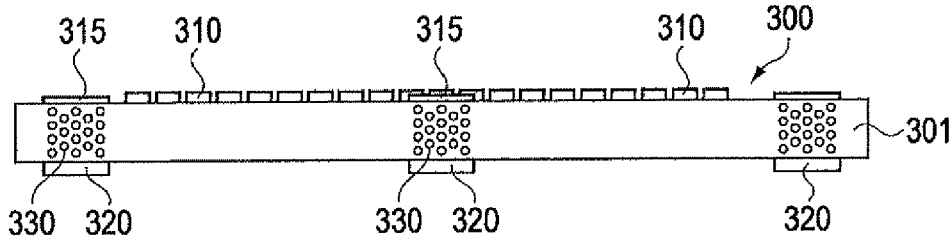

FIGS. 8A and 8B are diagrams showing a light emitting substrate 300 according to a third embodiment of the invention. FIG. 8A is a plan view thereof, and FIG. 8B is a side view thereof. The elements constituting a light emitting substrate 300 are approximately common to the light emitting substrate 300 according to the second embodiment. In other words, the light emitting substrate 300 is configured by a transparent substrate 301, organic EL elements 310 as light emitting elements that are disposed on the transparent substrate 301 in a zigzag pattern, light detecting units 320 disposed on the periphery of the organic EL elements, a plurality of reformation points 330 that is formed in areas in which the light detecting units 320 of the transparent substrate 301 are disposed and hinders the direct advance of light, a light reflecting layer 315, and the like.

A difference between the light emitting substrate of the second embodiment and the light emitting substrate of the third embodiment is that the positions of the light detecting units 320 and the light reflecting layer 315. On the bottom face of the transparent substrate 301, that is, a face opposite to a face (top face) on which the organic EL elements 310 are disposed, the light detecting units 320 are disposed, and the light reflecting layer 315 is disposed on the top face.

Under this configuration, a part of light that is emitted from the organic EL element 310 and reaches the bottom face without contacting the reformation point 330 even once can be received by the light detecting unit 320. In addition, by reflecting the light that advances toward the top face after being reflected diffusely by the reformation point 330 from the light reflecting layer 315 to advance toward a portion in which the reformation points 330 are disposed densely, the light can be reflected diffusely again. Then, a part of the light diffusely reflected again can be incident to the light detecting unit 320. Accordingly, the ratio of light incident to the light detecting unit to light emitted from the organic EL element 310 can be increased without changing the size of the light detecting unit 320 or the like. Therefore, the degree of aging degradation of each organic EL element 310 can be acquired much more accurately, and thus, a much more accurate correction (adjustment) process can be performed. Thereby, an image having much higher quality can be formed.

Fourth Embodiment

Figure 9A:
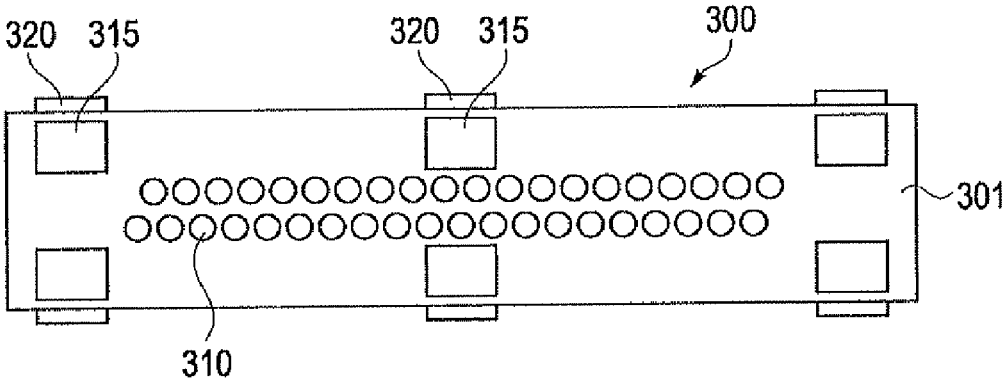
FIGS. 9A and 9B are schematic diagrams showing a light emitting substrate according to a fourth embodiment of the invention.
Figure 9B:
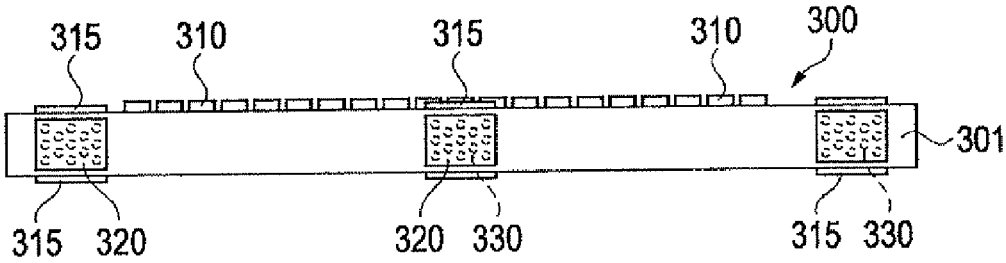

FIGS. 9A and 9B are diagrams showing the light emitting substrate 300 according to a fourth embodiment of the invention. FIG. 9A is a plan view thereof, and FIG. 9B is a side view thereof. The elements constituting a light emitting substrate 300 of this embodiment are approximately common to the light emitting substrate 300 according to the second or third embodiment. In other words, the light emitting substrate 300 is configured by a transparent substrate 301, organic EL elements 310 as light emitting elements that are disposed on the transparent substrate 301 in a zigzag pattern, light detecting units 320 disposed on the periphery of the organic EL elements, a plurality of reformation points 330 that is formed in areas in which the light detecting units 320 of the transparent substrate 301 are disposed and hinders the direct advance of light, and light reflecting layers 315. The disposed position of the light detecting unit 320 is different from that of the light emitting substrate 300 of the first embodiment.

In the light emitting substrate 300 according to this embodiment, in each area in which the light detecting unit 320 is disposed in the light emitting substrate 300 according to the first embodiment, and each area facing the area, the light reflecting layers 315 are disposed. In addition, the plurality of the reformation points 330 is formed between both the light reflecting layers 315 (in an area pinched by both the light reflecting layers 315). The light detecting units 320 are disposed on the side face of the part, in which the reformation points 330 are formed, of the transparent substrate 301.

Since the reformation points 330 are formed to be densely disposed between the light reflecting layers facing each other, the light advancing toward the top face or the bottom face of the transparent substrate 301 after being in contact with the reformation point 330 to be reflected diffusely is reflected from the light reflecting layer 315 on one side so as to advance toward the reformation point 330 again. Then, the light advancing toward the side face of the transparent substrate 301 after being in contact with the reformation point 330 to be reflected diffusely is incident to the light detecting unit 320. Accordingly, the ratio of light incident to the light detecting unit 320 to light emitted from the organic EL element 310 can be increased much. Therefore, a much more accurate correction (adjustment) process can be performed, and accordingly, an image having much higher quality can be formed.

Fifth Embodiment

Figure 10:
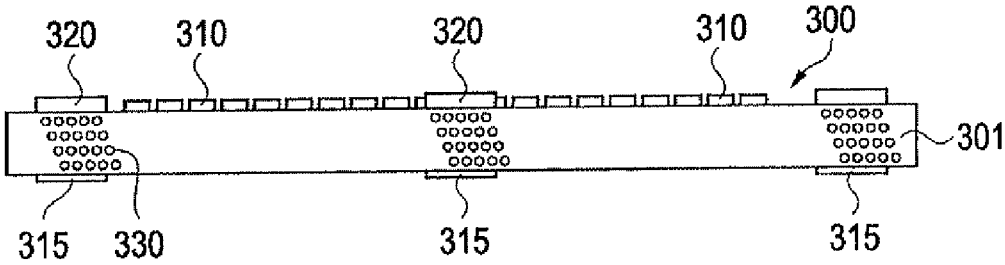
FIG. 10 is a schematic diagram showing a light emitting substrate according to a fifth embodiment of the invention.

FIG. 10 is a diagram showing a light emitting substrate 300 according to a fifth embodiment of the invention. The configuration of the light emitting substrate 300 according to this embodiment is approximately the same as that of the light emitting substrate 300 according to the second embodiment. In other words, the light emitting substrate 300 is configured by a transparent substrate 301, organic EL elements 310 as light emitting elements that are disposed on the transparent substrate 301 in a zigzag pattern, light detecting units 320 disposed on the periphery of the organic EL elements, a plurality of reformation points 330 that is formed in areas in which the light detecting units 320 of the transparent substrate 301 are disposed and hinders the direct advance of light, and a light reflecting layer 315. The light detecting units 320 are disposed on the top face of the transparent substrate 301.

The light emitting substrate 300 according to this embodiment has a special feature in disposition of the reformation points 330 in the direction of thickness (of the transparent substrate 301). Thus, a plan view thereof is omitted, and only a side view thereof is shown. The light emitting substrate 300 according to this embodiment has a special feature that the reformation points 330 are formed not to be overlapped with one another in the above-described direction of the thickness. Thus, light advancing toward the light detecting unit 320 side by being reflected from a reformation point 330 is suppressed to be reflected by being into contact with another reformation point 330, and accordingly, the ratio of light incident to the light detecting unit 320 to light emitted from the organic EL element 310 can be increased. Therefore, a much more accurate correction (adjustment) process can be performed, and accordingly, an image having much higher quality can be formed.

Sixth Embodiment

Figure 11:
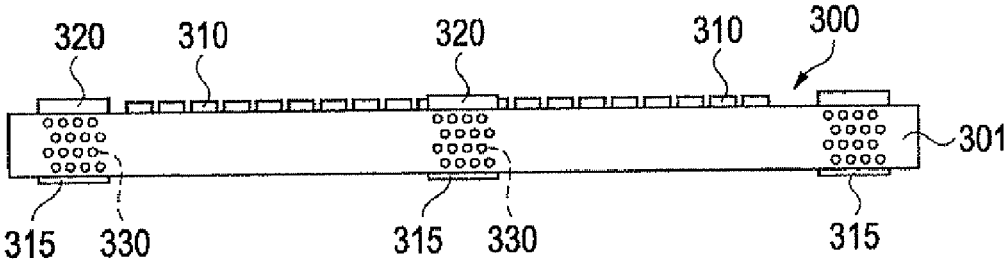
FIG. 11 is a schematic diagram showing a light emitting substrate according to a sixth embodiment of the invention.

FIG. 11 is a diagram showing a light emitting substrate 300 according to a sixth embodiment of the invention The configuration of the light emitting substrate 300 according to this embodiment is approximately the same as that of the light emitting substrate 300 according to the second embodiment. In other words, the light emitting substrate 300 is configured by a transparent substrate 301, organic EL elements 310 as light emitting elements that are disposed on the transparent substrate 301 in a zigzag pattern, light detecting units 320 disposed on the periphery of the organic EL elements, a plurality of reformation points 330 that is formed in areas in which the light detecting units 320 of the transparent substrate 301 are disposed and hinders the direct advance of light, and a light reflecting layer 315. The light detecting units 320 are disposed on the top face of the transparent substrate 301.

The light emitting substrate 300 according to this embodiment, similarly to the light emitting substrate 300 according to the fifth embodiment, has a special feature in disposition of the reformation points 330 in the direction of thickness (of the transparent substrate 301). Thus, a plan view thereof is omitted, and only a side view thereof is shown.

The light emitting substrate 300 according to this embodiment has a special feature in which the reformation points 330 are formed to have different densities in the above-described direction of the thickness. In other words, as the reformation points 330 are located closer to the top face, the density thereof becomes higher. Under the above-described configuration, diffuse reflection occurs with a high frequency in an area close to the light detecting unit 320. Accordingly, the light that is emitted from the organic EL element 310 and is transmitted near the light detecting unit 320 can be incident to the light detecting unit 320 at a high ratio. In addition, formation of an ineffective reformation point 330 can be suppressed, and accordingly, the manufacturing cost can be reduced.

Seventh Embodiment

Figure 12A:
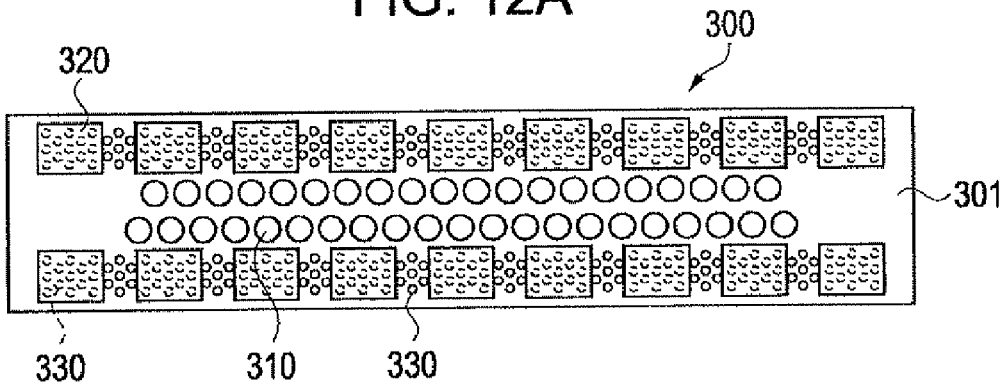
FIGS. 12A and 12B are schematic diagrams showing a light emitting substrate according to a seventh embodiment of the invention.
Figure 12B:
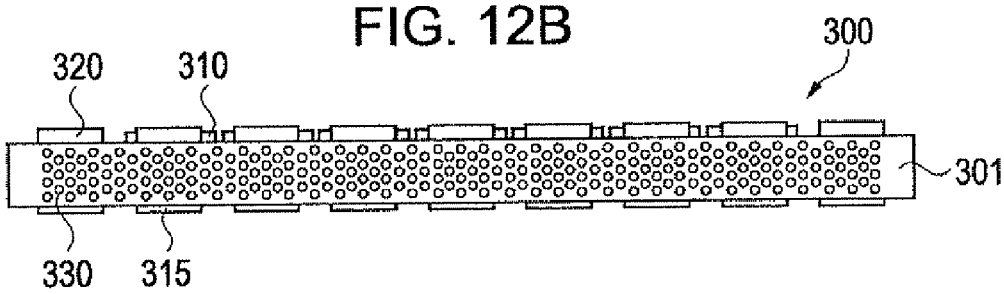

FIGS. 12A and 12B are diagrams showing a light emitting substrate 300 according to a seventh embodiment of the invention. FIG. 12A is a plan view thereof, and FIG. 12B is a side view thereof. The elements constituting the light emitting substrate 300 according to this embodiment are approximately common to the light emitting substrate 300 according to the second embodiment or the like. In other words, the light emitting substrate 300 is configured by a transparent substrate 301, organic EL elements 310 as light emitting elements that are disposed on the transparent substrate 301 in a zigzag pattern, light detecting units 320 disposed on the periphery of the organic EL elements, a plurality of reformation points 330 that is formed in areas in which the light detecting units 320 of the transparent substrate 301 are disposed and hinders the direct advance of light, and a light reflecting layer 315. In addition, the number of the light detecting units 320 and the like is increased, which is different from the light emitting substrate 300 according to the second embodiment.

In the light emitting substrate 300 according to this embodiment, the light detecting units 320 are disposed so as to surround the periphery of an area in which the organic EL elements 310 positioned in the center portion of the transparent substrate 301 are disposed in the zigzag pattern. In addition, in an area of the bottom face of the transparent substrate 301 which is overlapped with the light detecting unit 320 in the plan view, the light reflecting layer 315 is disposed, and the reformation point 330 is formed between the light reflecting layer and the light detecting unit 320.

Since the periphery of the organic EL elements 310 is surrounded by the light detecting units 320, the reformation points 330, and the light reflecting layer 315 in the plan view, light emitted from the organic EL elements 310 is incident to any one of the light detecting units 320 at a high probability. Thus, the ratio of light incident to the light detecting units 320 to light emitted from the light emitting elements can be increased further. Accordingly, a correction (adjustment) process having much more accuracy can be performed, and thereby an image having much higher quality can be formed.

In addition, the light reflecting layer 315 may be configured to be completely continuously in a circular shape. In addition, the light detecting units 320 may be disposed in a circular shape by forming a TFT (thin film transistor), a TFD (thin film diode), or the like on the transparent substrate 301.

MODIFIED EXAMPLES

Next, as modified examples, an organic EL device including a light emitting substrate 300 that has organic EL elements 310 as light emitting elements formed on a transparent substrate 301, light detecting units 320 that are disposed near the organic EL elements, and reformation points 330 that are formed near the light detecting units and an electronic apparatus having the organic EL device will be described.

Figure 13:
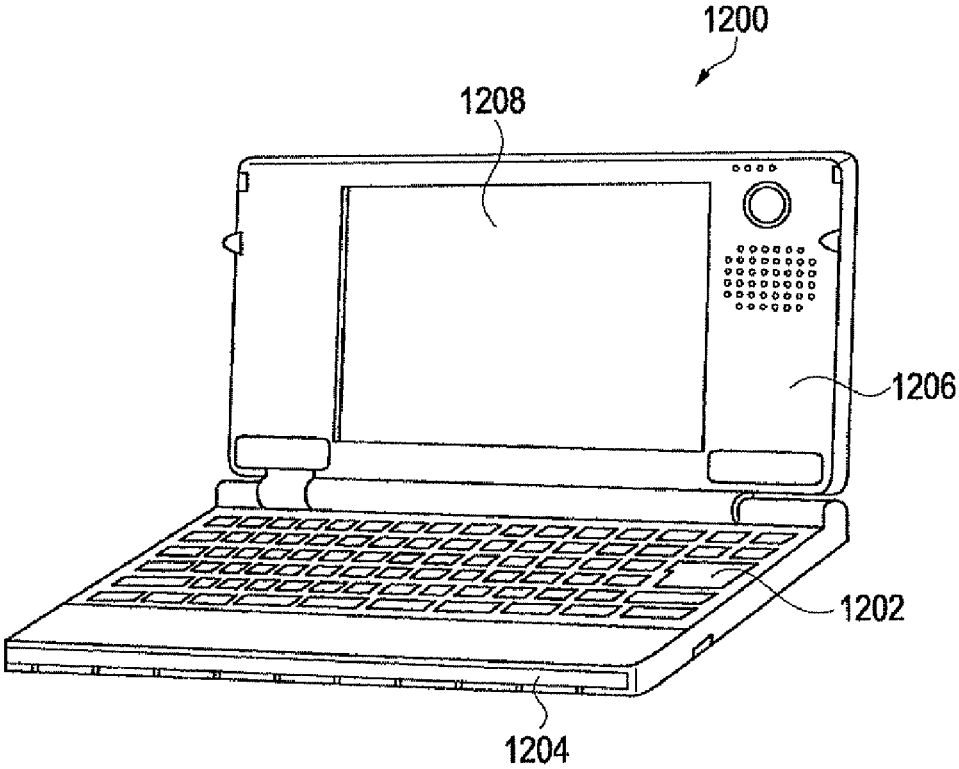
FIG. 13 is a diagram showing a personal computer as an electronic apparatus according to a modified example of the invention.

FIG. 13 is a diagram showing a personal computer as an electronic apparatus having the above-described organic EL device. The personal computer 1200 includes a main body unit 1204 having a keyboard 1202 and the organic EL device 1206 that includes the light emitting substrate having the light detecting units and the reformation points formed near the light detecting units and can display an image in a display area 1208.

Figure 14A:
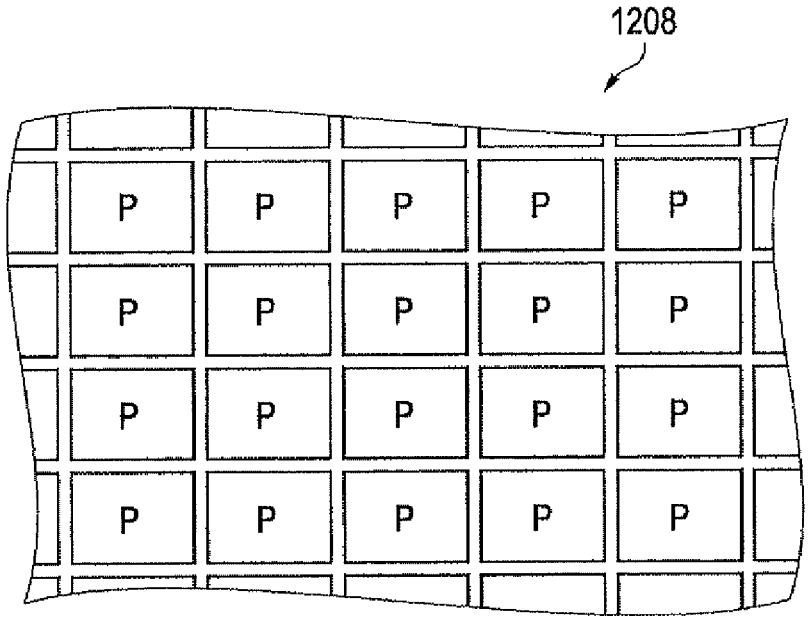
FIGS. 14A, 14B, and 14C are diagrams showing disposition of pixels and the like in a display area of an organic EL device according to a modified example of the invention.
Figure 14B:
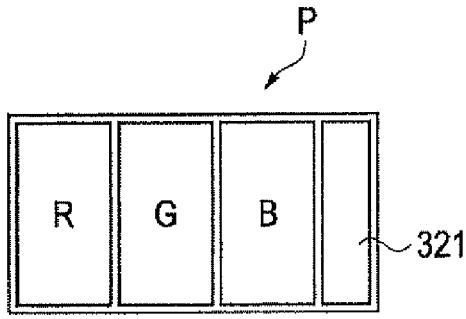
Figure 14C:
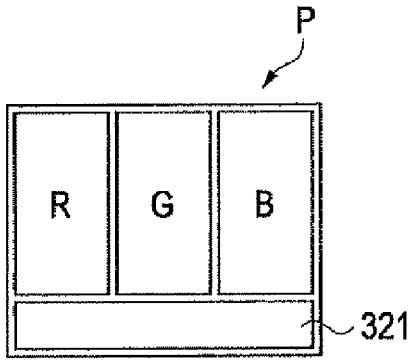

FIGS. 14A, 14B, and 14C are diagrams showing disposition of pixels and the like in the display area 1208 of the organic EL device 1206 according to a modified example. FIG. 14A shows the disposition of pixels P, and FIGS. 14B and 14C show an example of disposition of sub pixels and the light detecting units inside the pixel P. The organic EL device 1206 can display an image in colors. In addition, in the display area 1208 of the organic EL device 1206, as shown in FIG. 14A, the pixels P are regularly disposed By emitting light of which intensity (of light emission), hue, and the like are individually controlled from each pixel, a color image can be displayed in the display area 1208. In the figure, although the pixels P are disposed in the shape of a matrix, the pixels P may be disposed in a different shape such as a zigzag pattern.

Each pixel P includes one red pixel R that emits red light, one green pixel G that emits green light, and one blue pixel B that emits red light as sub pixels and at least one sensor TFT 321 as a light detecting unit. Each sub pixel includes an organic EL element 310 and a driving TFT 620 (see FIG. 15) to be described later. The disposition of the sub pixels and the like may be formed to be aligned in one row as shown in FIG. 14B. Alternatively, the disposition of the sub pixels and the like may be formed such that the sensor TFT 321 is adjacent to each sub pixel.

The organic EL device 1206 according to this embodiment, similarly to the above-described image forming apparatus 1, can measure the amount of light for each pixel by using the sensor TFT 321 by sequentially emitting all the sub pixels disposed in the display area at the time of input of the power source or the like. Then, by comparing the above-described measured values with measured values acquired by using a same technique at the time of manufacturing the organic EL device 1206, the degree of aging degradation for each sub pixel can be calculated to be used for correcting image display. In other words, the current for flowing though each organic EL element 310 or the like can be corrected for acquiring a desired amount of light.

As described later, since the plurality of reformation points 330 (see FIG. 15) is formed in the area in which the sensor TFT 321 as the light detecting unit is formed, the ratio of light incident to the sensor TFT 321 to light emitted from the organic EL element 310 can be increased. As a result, the above-described correction can be performed with much higher accuracy, and accordingly, an image having much higher quality can be displayed.

In the process of image display, the organic EL device 1206 acquires arbitrary amounts of light by supplying currents of different values or the like to the pixels. However, in the above-described process of measuring the amounts of light, the organic EL device 1206 supplies a same current to the organic EL elements included in all the pixels (sub pixels). Thus, the above-described measured values are measured values of the amounts of light emitted from each organic EL element 310 in a case where the same current is supplied to the organic EL elements 310. Hereinafter, the configuration of the organic EL device 1206 according to this modified example will be described.

Figure 15:
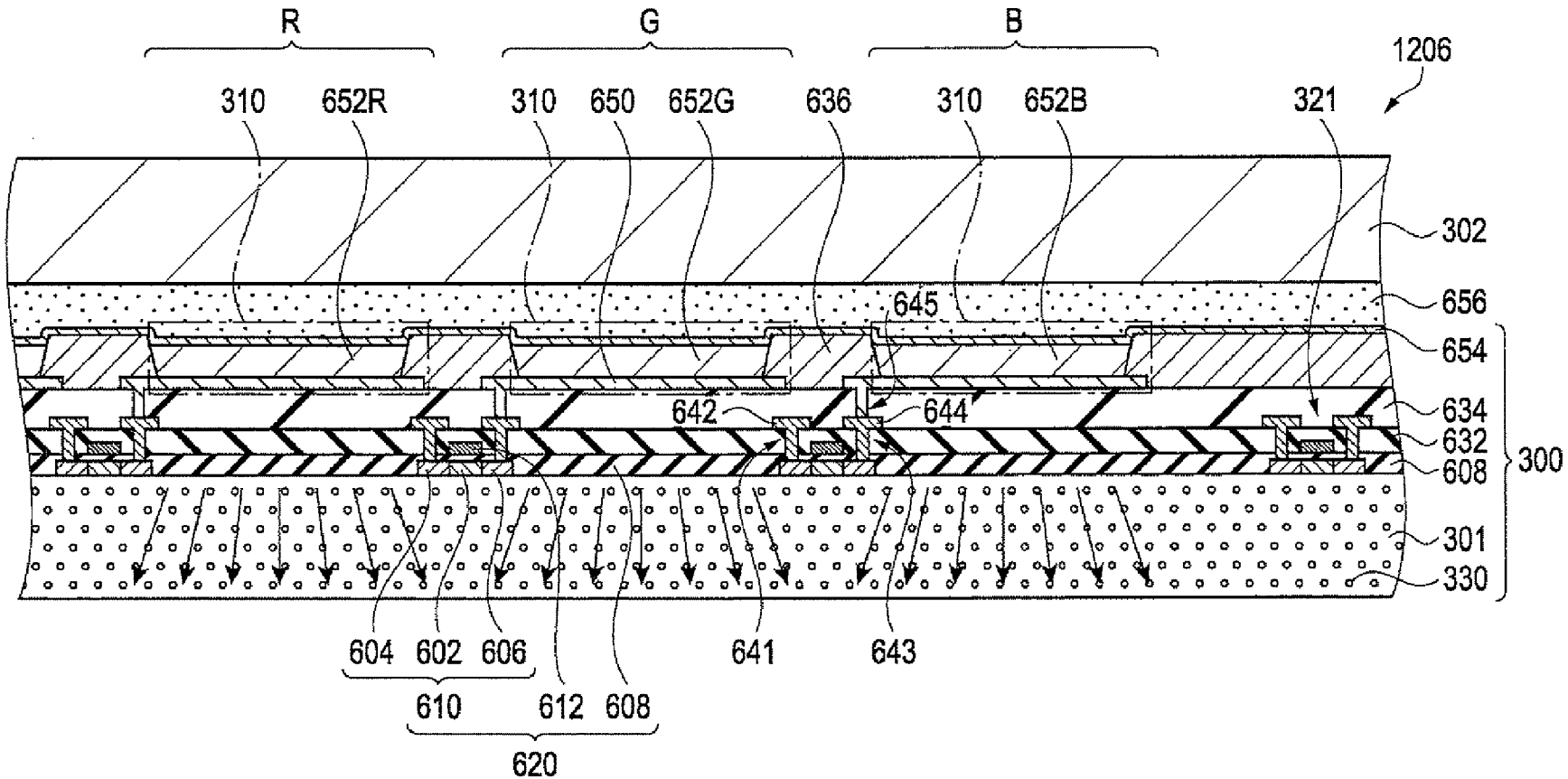
FIG. 15 is a schematic cross-section view of a pixel of a light emitting substrate that is included in an organic EL device according to the modified example.
Figure 16A:
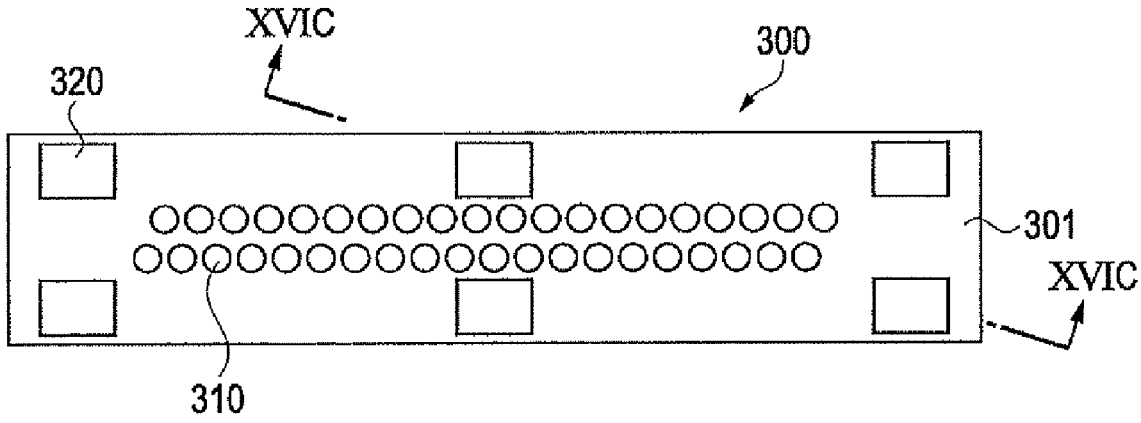
FIGS. 16A, 16B, and 16C are schematic diagrams showing a light emitting substrate included in a general exposure head.
Figure 16B:
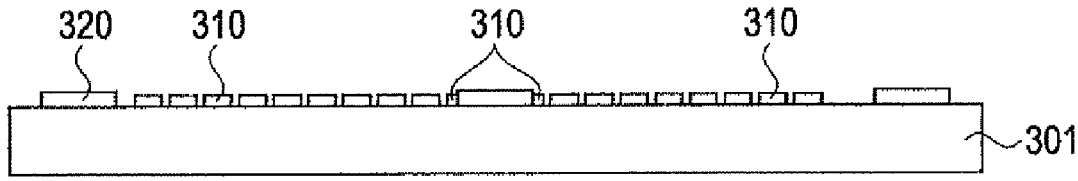
Figure 16C:
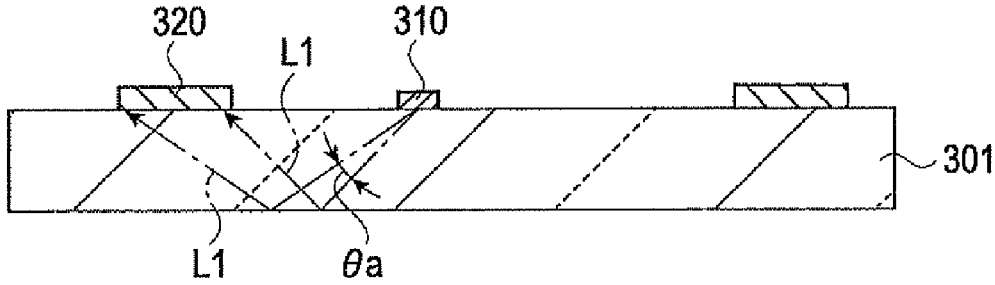

FIG. 15 is a schematic cross-section view of an area configuring one pixel P of the light emitting substrate 300 that is included in the organic EL device 1206 according to this modified example. The light emitting substrate 300 is configured by a transparent substrate 301, a driving TFT 620 that is formed on the transparent substrate, organic EL elements 310, and the like. In addition, the light emitting substrate 300 is bonded to an opposing substrate 302 through an adhesive layer 656 as described later so as to form the organic EL device 1206. As shown in the figure, the pixel P is configured by the organic EL element 310 that is formed between the transparent substrate 301 and the opposing substrate 302 and the like. As described above, the pixel P is formed by three types of sub pixels and the sensor TFT 321 as the light detecting unit. As described above, each sub pixel is configured by the organic EL element 310, the driving TFT 620 that drives the organic EL element, a retention capacitor not shown in the figure, and the like.

As shown in the figure, the sensor TFT 321 is formed on the transparent substrate 301 to be positioned next to the driving TFT 620. The sensor TFT 321 receives a part of the light emitted by each organic EL element 310 so as to measure the intensity of light emission of each organic EL element 310. By correcting (adjusting) the magnitudes of currents to be supplied to the organic EL elements 310 based on the result of the measurement, an image having high quality can be displayed (formed).

In addition, inside the transparent substrate 301 of the area, in which the sensor TFT 321 is formed, of the light emitting substrate 300 that is included in the organic EL device 1206 according to this embodiment, the plurality of the reformation points 330 are densely formed. Similar to the above-described exposure head 29, the sensor TFT 321 of the organic EL device 1206 according to this embodiment can receive light emitted by the organic EL elements at a high ratio due to the reformation points 330. Accordingly, the above-described correction can be performed more effectively. The configurations of the organic EL element 310 and the driving TFT 620 are as below.

On the transparent substrate 301, a semiconductor layer 610 that is formed by patterning a multi-crystal silicon layer in the shape of an island, a gate insulation film 608 that is formed of an insulation material such as $SiO_2$, and a gate electrode 612 that is formed of high-melting-point metal such as chrome are sequentially formed. An area of the semiconductor layer 610 which is overlapped with the gate electrode 612 in the plan view is a channel region 602, and impurity such as P (phosphorus) is introduced into both sides of the area so as to form a source region 604 and a drain region 606. By these elements, the driving TFT 620 is configured. In addition, a buffer layer that is formed of $SiO_2$ or the like may be formed between the transparent substrate 301 and the semiconductor layer 610.

On the gate electrode 612, a first interlayer insulation film 632 that is formed of $SiO_2$ or the like is formed. In positions corresponding to the source region 604 and the drain region 606 of the semiconductor layer 610, a first contact hole 641 and a second contact hole 643 are formed. In both contact holes, a source electrode 642 and a drain electrode 644 that are formed of aluminum or the like are formed, and on both the electrodes, a second interlayer insulation film 634 that is formed of $SiO_2$ or the like is formed. In addition, in a position corresponding to the drain electrode 644 of the second interlayer insulation film 634, a third contact hole 645 is formed, and a pixel electrode (anode) 650 that is connected to the drain electrode 644 through the third contract hole is formed. The pixel electrode 650 is formed by patterning a transparent conduction material layer such as ITO (Indium Tin Oxide) in the shape of an island. The pixel electrode 650 is electrically connected to a function layer to be described later and can emit light to the outside of the light emitting substrate 300 through the transparent substrate 301 by releasing light generated inside the function layer. The organic EL element 310 included in the organic EL device 1206 according to this embodiment is a bottom-emission type in which light is emitted to the transparent substrate 301 side. The pixel electrodes 650 are partitioned by partition walls 636 that are formed by patterning an organic material layer formed of polyimide having the insulating property or an inorganic material layer having the insulating property so as to expose the pixel electrodes 650.

In a concave part that is formed by the partition walls 636 and the pixel electrode 650, the function layer corresponding to light emitted by the organic EL element 310 included in each sub pixel is formed. In other words, a red function layer 652R corresponding to red light is formed in a red pixel R, a green function layer 652G corresponding to green light is formed in a green pixel G, and a blue function layer 652B corresponding to blue light is formed in a blue pixel B. In addition, (although not shown in the figure), each function layer is formed by laminating a hole injection and transport layer, a light emitting layer, and an electron injection and transport layer. Of the three elements, a different element among the sub pixels is only the light emitting layer. Thus, the hole injection and transport layer and the electron injection and transport layer are common to the sub pixels.

On the function layers and the partition walls 636, a cathode 654 that is formed of aluminum, magnesium-silver alloy, or the like is formed on the entire surface of the light emitting substrate 300. The pixel electrode 650, the cathode 654, and the function layer interposed between one pair of the electrodes form the organic EL element 310. By having a current flow through the function layer (the light emitting layer included therein) by applying a voltage between the pixel electrode 650 and the cathode 654, holes supplied from the pixel electrode 650 and electrons supplied from the cathode are combined together inside the light emitting layer. Then, the light emitting layer (or the light emitting material included therein) excited by the energy generated by the combination generates light at a time when the light emitting layer returns to the ground state from the excited state. The light emitting substrate 300 forms an image by emitting the light from the transparent substrate 301. Then, the light emitting substrate 300 is completed by forming the cathode 654, and the light emitting substrate is bonded to the opposing substrate 302 through the adhesive layer 656 for forming the organic EL device 1206.

On the transparent substrate 301, the sensor TFT 321 as the light detecting unit is formed together with the sub pixel. The configuration of the sensor TFT 321 (except for the size) is the same as that of the driving TFT 620. However, the use of the sensor TFT 321 is different from that of the driving TFT 620. Accordingly, the sensor TFT 321 can be formed simultaneously with the driving TFT 620 without adding another process.

In the measurement of the amount of light at the above-described time of input of the power source or the like, the sensor TFT 321 receives a part of light emitted by an adjacent pixel and outputs a current or a voltage corresponding to the intensity of the received light, that is, the degree of degradation. Then, the value of the current or voltage is transmitted to a control circuit disposed on the periphery of the pixels P disposed in the shape of a matrix to be stored. The sensor TFT 321 is disposed for each pixel P formed by the sub pixels, and accordingly, the degree of degradation of each sub pixel can be detected. Accordingly, the above-described control circuit can correct the decrease in the amount of light due to the degradation by supplying different currents to the sub pixels (corresponding to the degree of degradation of each sub pixel) at the time of image display. As a result, the organic EL device 1206 according to this embodiment can display an image having high quality all the time in spite of the aging degradation of the organic EL elements 310.

Here, the light emitted by the above-described organic EL elements, as denoted by arrows shown in FIG. 15, advance toward the direction perpendicular to the transparent substrate 301 at a high ratio. However, as described in the above-described first embodiment, light is reflected form the surface of a part (a boundary face between the transparent substrate and the outside thereof) in which the light is projected at an angle within the predetermined angle range to the transparent substrate 301 so as to advance toward the transparent substrate 301. In addition, a part of the part of the light is incident to the semiconductor layer 610 of the sensor TFT 321.

In addition, in areas in which the sensor TFTs 321 are formed, the plurality of the reformation points 330 are densely formed. Accordingly, as described in the above-described first embodiment, light incident to the area of the transparent substrate 301 which is overlapped with the sensor TFT 321 in the plan view can be received effectively. Thus, the aging degradation of the organic EL elements 310 can be acquired more accurately, and accordingly, a more desired adjustment (correction) process can be performed. As a result, the personal computer 1200 as an electronic apparatus including the organic EL device 1206 can display an image having much higher quality.

The entire disclosure of Japanese Patent Application No. 2008-028492, filed Feb. 8, 2008 is expressly incorporated by reference herein.

What is claimed is:

1. An exposure head comprising a light emitting substrate including:

a transparent substrate;

a plurality of light emitting elements that are disposed on one face of the transparent substrate;

at least one light detecting unit that is disposed on the transparent substrate and is configured to detect light emitted from the plurality of light emitting elements and propagating inside the transparent substrate;

a plurality of reformation points disposed inside the transparent substrate and configured to diffusely reflect light propagating inside the transparent substrate, wherein densities of formation of the reformation points are different in accordance with the position inside the transparent substrate; and a light reflecting layer that is disposed in at least a part of an area of the surface of the transparent substrate excluding areas in which the plurality of light emitting elements are disposed, areas facing the plurality of light emitting elements, and areas in which the at least one light detecting unit is disposed, and is configured to reflect light emitted from the plurality of light emitting elements, wherein light that is emitted from at least one of the plurality of light emitting elements and is transmitted through the transparent substrate is projected on an image carrier that faces the plurality of light emitting elements with the transparent substrate interposed therebetween so as to form a predetermined pattern on the image carrier.

2. The exposure head according to claim 1, wherein the light emitting elements are organic EL elements.

3. The exposure head according to claim 1, wherein the reformation points are formed by using a laser beam.

4. An image forming unit comprising the exposure head according to claim 1.

5. An image forming apparatus comprising the exposure head according to claim 1.

* * * * *